US006402003B1

(12) United States Patent
Jackson

(10) Patent No.: US 6,402,003 B1
(45) Date of Patent: Jun. 11, 2002

(54) FRONT AND BACK BOOK SACK

(76) Inventor: Catherine A. Jackson, 7512 Hwy. 301, S., Four Oaks, NC (US) 27524

( * ) Notice: Subject to any disclaimer, the term of this patent is extended or adjusted under 35 U.S.C. 154(b) by 13 days.

(21) Appl. No.: 09/713,569

(22) Filed: Nov. 15, 2000

(51) Int. Cl.[7] ..... A45F 3/04
(52) U.S. Cl. ..... 224/646; 224/627; 224/640
(58) Field of Search ..... 224/627, 637, 224/638, 640, 643, 645, 646; D3/216, 217

(56) References Cited

U.S. PATENT DOCUMENTS

| | | | | |
|---|---|---|---|---|
| 3,848,267 A | * | 11/1974 | DeSpain | 2/94 |
| 4,483,469 A | | 11/1984 | Arisland | 224/151 |
| 4,544,087 A | * | 10/1985 | Modig | 224/148.2 |
| 4,948,023 A | * | 8/1990 | Tripp | 222/175 |
| 5,129,560 A | | 7/1992 | Herman | 224/151 |
| 5,577,652 A | | 11/1996 | Cooper | 224/578 |
| 5,586,703 A | * | 12/1996 | Radar et al. | 224/148.2 |
| 5,630,536 A | | 5/1997 | Bugnaski | 224/600 |
| 5,657,917 A | | 8/1997 | Johnson et al. | 224/682 |
| 5,799,851 A | | 9/1998 | Wulf et al. | 224/683 |
| 6,135,333 A | * | 10/2000 | Tucker et al. | 224/609 |

FOREIGN PATENT DOCUMENTS

| | | | |
|---|---|---|---|
| FR | 2387002 | * 12/1978 | 224/209 |

* cited by examiner

*Primary Examiner*—Gregory M. Vidovich
(74) *Attorney, Agent, or Firm*—Joseph N. Breaux

(57) ABSTRACT

A book sack that includes front and back carrying compartments connected by a pair of padded shoulder straps. The use of front and back carrying compartments allows a child to properly balance the weight of the items to be carried. This balanced loading would place less strain on the child's spinal column and would, thereby, reduce both acute and chronic back injuries.

2 Claims, 3 Drawing Sheets

FRONT AND BACK BOOK SACK

TECHNICAL FIELD

The present invention relates to book sacks for carrying books and the like and more particularly to a front and back book sack that includes a back compartment portion having a back item carrying compartment provided therein that is secured to a front compartment portion having a front item carrying compartment provided therein with left and right padded shoulder straps.

BACKGROUND ART

Each year many small children develop back injuries when they carry book sacks that are overloaded and often using only one of the two conventionally provided book sack straps. Conventional, back pack type, book sacks place an unbalanced load on the developing spinal column of the child and can lead to acute back injuries, such as ruptured disks and the like, and/or chronic back injuries that manifest themselves years later when it is to late to prevent them. It would be a benefit, therefore, to have a book sack that included carrying compartments for allowing a child to properly balance the weight of the items to be carried by dividing the items between a front carrying compartment and a back carrying compartment of the book sack. This balanced loading would place less strain on the child's spinal column and would, thereby, reduce both acute and chronic back injuries.

GENERAL SUMMARY DISCUSSION OF INVENTION

It is thus an object of the invention to provide a front and back book sack that includes a back compartment portion having a back item carrying compartment provided therein that is secured to a front compartment portion having a front item carrying compartment provided therein with left and right padded shoulder straps.

It is a further object of the invention to provide a front and back book sack that includes a back compartment portion having a back item carrying compartment provided therein, a front compartment portion having a front item carrying compartment provided therein, a front connector panel portion, a left padded shoulder strap, a right padded shoulder strap, two left side compartment portion connecting straps, a right side compartment portion connecting strap, a front buckle member attached to the bottom right side of the front compartment portion and an elongated right side compartment connecting strap having a first strap end secured to a bottom right side of the back compartment portion and a second strap end detachably securable to the front buckle member; the left padded shoulder strap being secured between a top of the back compartment portion and a top of the front compartment portion; the right padded shoulder strap being secured between a top of the back compartment portion and a top of the front connector panel portion; the two left side compartment portion connecting straps being secured between the left side of the back compartment portion and the left side of the front compartment portion; the right side compartment portion securing strap being secured between a right side of the back compartment portion and a right side of the front connector panel portion; the left padded shoulder strap being adjustably secured to the top of the back compartment portion with a left shoulder strap buckle provided on the back compartment portion; the right padded shoulder strap being adjustably secured to the top of the back compartment portion with a right shoulder strap buckle provided on the back compartment portion; the front connector panel portion having a back compartment portion facing panel surface and a front compartment portion facing panel surface; the front compartment portion facing panel surface having a connecting panel area thereof covered with hook and pile fastener material; the front compartment portion having a user facing compartment portion safety panel constructed from a puncture resistant material, such as leather, having sufficient puncture resistance to prevent pens, pencils, scissors and the like from penetrating the user facing compartment portion safety panel should a user fall forward while such an item is carried in the front item carrying compartment; the user facing compartment portion safety panel having safety panel area thereof covered with hook and pile fastener material that is companionate with the hook and pile fastener material of the connecting panel area.

Accordingly, a front and back book sack is provided. The front and back book sack includes a back compartment portion having a back item carrying compartment provided therein, a front compartment portion having a front item carrying compartment provided therein, a front connector panel portion, a left padded shoulder strap, a right padded shoulder strap, two left side compartment portion connecting straps, a right side compartment portion connecting strap, a front buckle member attached to the bottom right side of the front compartment portion and an elongated right side compartment connecting strap having a first strap end secured to a bottom right side of the back compartment portion and a second strap end detachably securable to the front buckle member; the left padded shoulder strap being secured between a top of the back compartment portion and a top of the front compartment portion; the right padded shoulder strap being secured between a top of the back compartment portion and a top of the front connector panel portion; the two left side compartment portion connecting straps being secured between the left side of the back compartment portion and the left side of the front compartment portion; the right side compartment portion securing strap being secured between a right side of the back compartment portion and a right side of the front connector panel portion; the left padded shoulder strap being adjustably secured to the top of the back compartment portion with a left shoulder strap buckle provided on the back compartment portion; the right padded shoulder strap being adjustably secured to the top of the back compartment portion with a right shoulder strap buckle provided on the back compartment portion; the front connector panel portion having a back compartment portion facing panel surface and a front compartment portion facing panel surface; the front compartment portion facing panel surface having a connecting panel area thereof covered with hook and pile fastener material; the front compartment portion having a user facing compartment portion safety panel constructed from a puncture resistant material, such as leather, having sufficient puncture resistance to prevent pens, pencils, scissors and the like from penetrating the user facing compartment portion safety panel should a user fall forward while such an item is carried in the front: item carrying compartment; the user facing compartment portion safety panel having safety panel area thereof covered with hook and pile fastener material that is companionate with the hook and pile fastener material of the connecting panel area.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
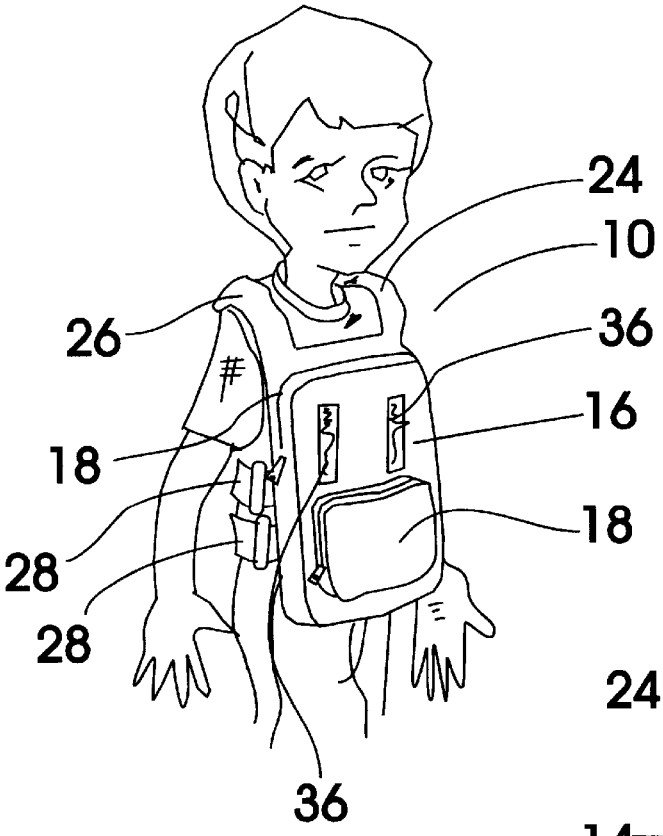
FIG. 1 is a front perspective view of an exemplary embodiment of the front and back book sack of the present invention with the front compartment portion supported against the user's stomach area.
Figure 2:
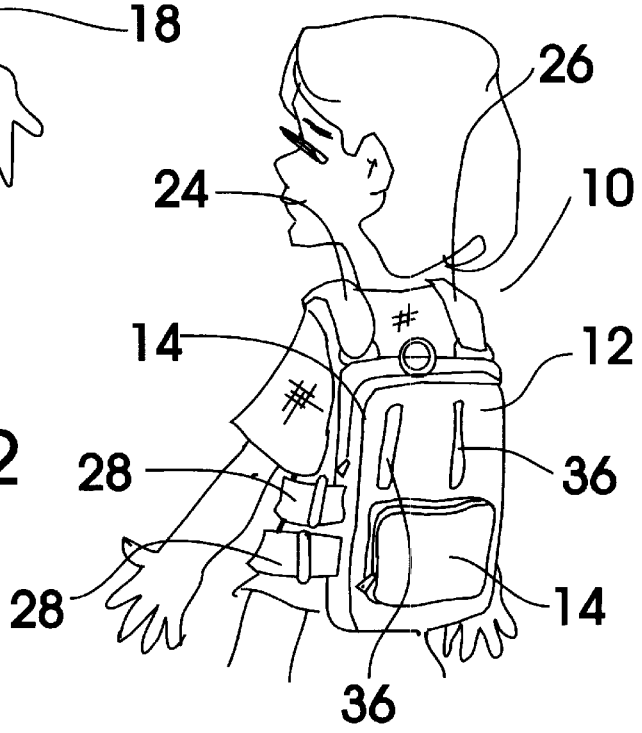
FIG. 2 is a rear perspective view of the exemplary front and back book sack of FIG. 1 with the back compartment portion supported against the user's back.
Figure 3:
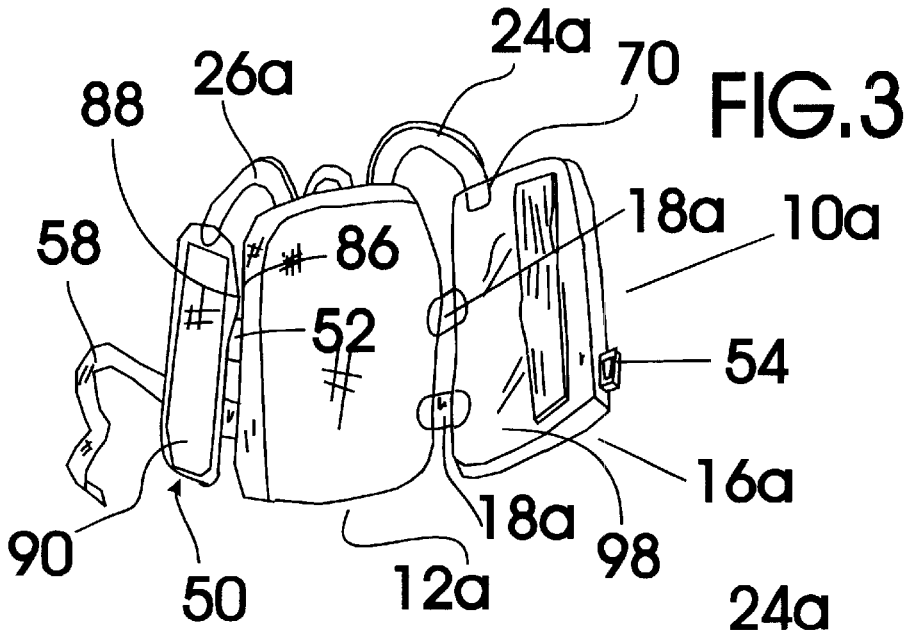
FIG. 3 is a perspective view of a second exemplary embodiment of the front and back book sack of the present invention that includes a back compartment portion having a back item carrying compartment provided therein, a front compartment portion having a front item carrying compartment provided therein, a front connector panel portion, a left padded shoulder strap, a right padded shoulder strap, two left side compartment portion connecting straps, a right side compartment portion connecting strap, a front buckle member attached to the bottom right side of the front compartment portion and an elongated right side compartment connecting strap having a first strap end secured to a bottom right side of the back compartment portion and a second strap end detachably securable to the front buckle member; the left padded shoulder strap being secured between a top of the back compartment portion and a top of the front compartment portion; the right padded shoulder strap being secured between a top of the back compartment portion and a top of the front connector panel portion; the two left side compartment portion connecting straps being secured between the left side of the back compartment portion and the left side of the front compartment portion; the right side compartment portion securing strap being secured between a right side of the back compartment portion and a right side of the front connector panel portion; the left padded shoulder strap being adjustably secured to the top of the back compartment portion with a left shoulder strap buckle provided on the back compartment portion; the right padded shoulder strap being adjustably secured to the top of the back compartment portion with a right shoulder strap buckle provided on the back compartment portion; the front connector panel portion having a back compartment portion facing panel surface and a front compartment portion facing panel surface; the front compartment portion facing panel surface having a connecting panel area thereof covered with hook and pile fastener material; the front compartment portion having a user facing compartment portion safety panel constructed from a puncture resistant material, such as leather, having sufficient puncture resistance to prevent pens, pencils, scissors and the like from penetrating the user facing compartment portion safety panel should a user fall forward while such an item is carried in the front item carrying compartment; the user facing compartment portion safety panel having safety panel area thereof covered with hook and pile fastener material that is companionate with the hook and pile fastener material of the connecting panel area.
Figure 4:
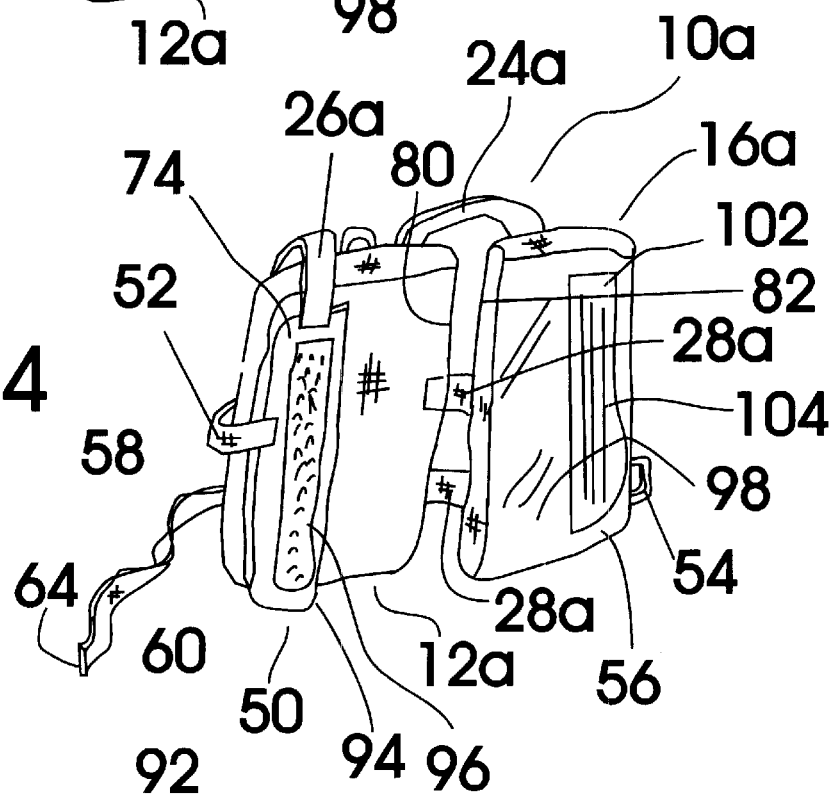
FIG. 4 is a front perspective view of the exemplary front and back book sack of FIG. 3 with the front connector panel portion folded forward to show the hook and pile fastener material of the connecting panel area.
Figure 5:
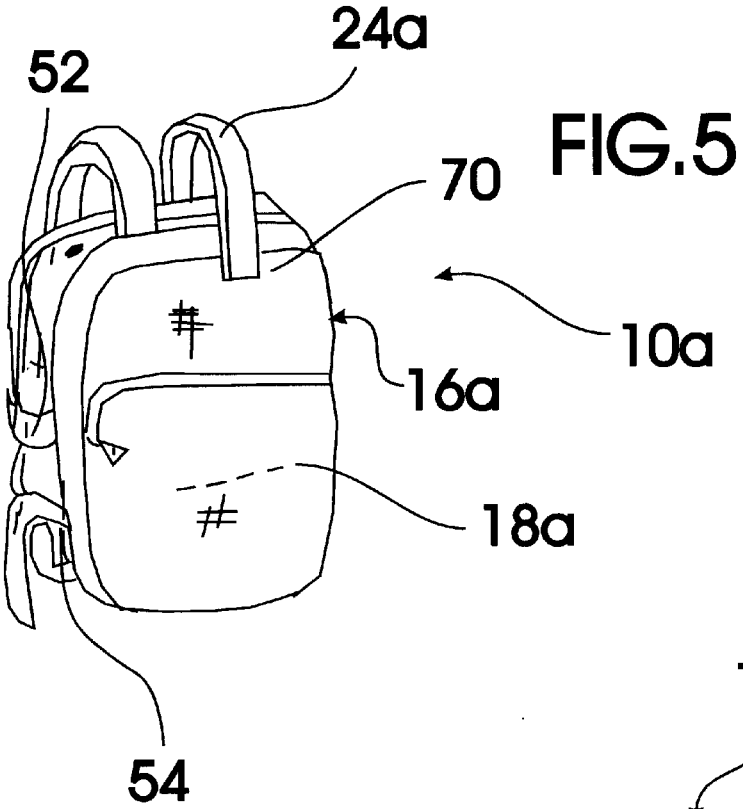
FIG. 5 is a front side perspective view of the exemplary front and back book sack of FIG. 3.
Figure 6:
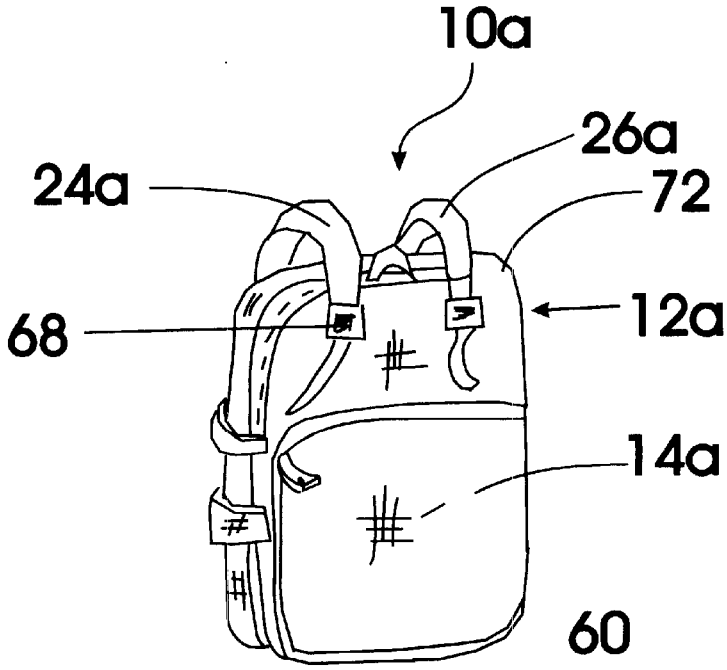
FIG. 6 is a back side perspective view of the exemplary front and back book sack of FIG. 3.

FIGS. 1 and 2 show various aspects of a first exemplary embodiment of the front and back book sack of the present invention generally designated 10. Front and back book sack 10 includes a back compartment portion, generally designated 12, having a number of back item carrying compartments 14 provided therein that is secured to a front compartment portion, generally designated 16, having a number of front item carrying compartments 18 provided therein. In this embodiment back and front compartment portions 12,16 are constructed from heavy canvas, however, it should be understood, that various embodiments may be constructed from materials such as leather, fabric and plastic and in various colors including an embodiment for hunters that is hunter orange when worn in one configuration and which can be reversed to expose a camouflage pattern when worn in the opposite configuration. It should also be understood that carrying compartments 14,18 may constructed in any desired shape, width or size and may be sealable with any conventional compartment sealing mechanism including but not limited to zippers, hook and pile fasteners, snaps, etc. without departing from the spirit of the invention taught herein. Back and front compartment portions 12,16 are secured at the top edges thereof with adjustable left and right padded shoulder straps 24,26 and on the left and right sides with adjustable side straps 28. Although adjustable left and right padded shoulder straps 24,26 and adjustable left and right straps 28 are adjustable, they need not be adjustable to practice the invention taught herein. For added safety, in this embodiment, reflector strips 36 are adhesively attached to back and front compartment portion 12,16. The child puts front and back book sack 10 on by raising front and back book sack 10 above his/her head and slipping his/her head between back and front compartment portions 12,16 and out between left and right padded shoulder straps 24,26.

FIGS. 3–6 show various aspects of a second exemplary embodiment of the front and back book sack of the present invention generally designated 10*a*. Front and back book sack 10*a* includes a back compartment portion, generally designated 12*a*, having a back item carrying compartment 14*a* provided therein; a front compartment portion, generally designated 16*a*, having a front item carrying compartment 18*a* provided therein; a front connector panel portion, generally designated 50; a left padded shoulder strap 24*a*; a right padded shoulder strap 26*a*; two left side compartment portion connecting straps 28*a*; a right side compartment portion connecting strap 52; a front buckle member 54 attached to the bottom right side 56 of front compartment portion 16*a*; and an elongated right side compartment connecting strap 58 having a first strap end secured to a bottom right side 60 of back compartment portion 12*a* and a second strap end 64 that is detachably securable to the front buckle member 54 (see FIG. 5). Left padded shoulder strap 24*a* is secured between a top buckle 68 of back compartment portion 12*a* and a top edge 70 of front compartment portion 16*a*. Right padded shoulder strap 26*a* is secured between a top buckle member 72 of back compartment portion 12*a* and a top edge 74 of front connector panel portion 50. The two left side compartment portion connecting straps 28*a* are secured between the left side 80 of back compartment portion 12*a* and the left side 82 of front compartment portion 16*a*. Right side compartment portion securing strap 52 is secured between a right side 86 of back compartment portion 12*a* and a right side 88 of front connector panel portion 50. Left and right padded shoulder straps 24*a*,26*a* are adjustable by using top buckles 68,72, respectively.

Front connector panel portion 50 has a back compartment portion facing panel surface 90 and a front compartment portion facing panel surface 92. Front compartment portion facing panel surface 92 has a connecting panel area 94 thereof covered with hook and pile fastener material 96. Front compartment portion 16*a* has a user facing compartment portion safety panel 98 constructed from a puncture resistant, heavy leather material that is sufficiently puncture resistance to prevent pens, pencils, scissors and the like from penetrating the user facing compartment portion safety panel 98 and injuring the child should the child fall forward while such an item is in the front item carrying compartment 14*a*. User facing compartment portion safety panel 98 has a safety panel area 102 thereof covered with hook and pile fastener material 104 that is companionate with the hook and pile fastener material 96 of the connecting panel area 96.

In use, the user puts front and back book sack 10*a* on by inserting his/her neck between left and right padded shoulder straps 24*a*,26*a*; positioning his/her left shoulder below left padded shoulder strap 24*a*; positioning his/her right shoulder below right padded shoulder strap 26*a*; and then rotating hook and pile fastener material 104 of front compartment member 14*a* into contact with companionate hook and pile fastener material 96 of connecting panel 50.

It can be seen front the preceding description that a front and back book sack has been provided.

It is noted that the embodiment of the front and back book sack described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A front and back book sack comprising:

a back compartment portion having a back item carrying compartment provided therein;

a front compartment portion having a front item carrying compartment provided therein;

a front connector panel portion;

a left padded shoulder strap;

a right padded shoulder strap;

two left side compartment portion connecting straps;

a right side compartment portion connecting strap;

a front buckle member attached to the bottom right side of the front compartment portion; and an elongated right side compartment connecting strap having a first strap end secured to a bottom right side of the back compartment portion and a second strap end detachably securable to the front buckle member;

the left padded shoulder strap being secured between a top of the back compartment portion and a top of the front compartment portion;

the right padded shoulder strap being secured between a top of the back compartment portion and a top of the front connector panel portion;

the two left side compartment portion connecting straps being secured between the left side of the back compartment portion and the left side of the front compartment portion;

the right side compartment portion securing strap being secured between a right side of the back compartment portion and a right side of the front connector panel portion;

the left padded shoulder strap being adjustably secured to the top of the back compartment portion with a left shoulder strap buckle provided on the back compartment portion;

the right padded shoulder strap being adjustably secured to the top of the back compartment portion with a right shoulder strap buckle provided on the back compartment portion;

the front connector panel portion having a back compartment portion facing panel surface and a front compartment portion facing panel surface;

the front compartment portion facing panel surface having a connecting panel area thereof covered with hook and pile fastener material;

the front compartment portion having a user facing compartment portion covered with hook and pile fastener material that is companionate with the hook and pile fastener material of the connecting panel area.

2. The front and back book sack of claim 1 wherein:

the user facing compartment portion of the front compartment portion being constructed from a puncture resistant material having sufficient puncture resistance to prevent tapered items from penetrating the user facing compartment portion should a user fall forward while such a tapered item is carried in the front item carrying compartment.

* * * * *